United States Patent [19]

Myers

[11] 4,312,187

[45] Jan. 26, 1982

[54] METHOD AND APPARATUS FOR SEPARATING OIL FROM A REFRIGERANT

[75] Inventor: William E. Myers, Norwood, N.C.

[73] Assignee: Lillian S. Myers, Norwood, N.C.

[21] Appl. No.: 140,164

[22] Filed: Apr. 14, 1980

[51] Int. Cl.[3] ..... F25B 43/02

[52] U.S. Cl. ..... 62/84; 62/470; 233/11

[58] Field of Search ..... 62/84, 468, 470, 471, 62/472, 473; 233/11

[56] References Cited

U.S. PATENT DOCUMENTS 2,373,349 4/1945 Serrell ..... 233/11

2,813,404 11/1957 Hirsch ..... 62/471

3,304,697 2/1967 Ramsey ..... 62/471

*Primary Examiner*—Ronald C. Capossela

*Attorney, Agent, or Firm*—Bell, Seltzer, Park & Gibson

[57] ABSTRACT

A method and apparatus is provided for the continuous separation of oil from the refrigerant in a vapor compression refrigeration apparatus. The separation is accomplished by centrifuging the liquid refrigerant, while cooling the refrigerant to facilitate the separation of the oil. There is also provided an oil still for removing and recovering any refrigerant remaining in the separated oil, and a heat exchanger is provided for initially cooling the refrigerant prior to being centrifuged, and heating the refrigerant after being centrifuged.

12 Claims, 3 Drawing Figures

METHOD AND APPARATUS FOR SEPARATING OIL FROM A REFRIGERANT

Figure 1:
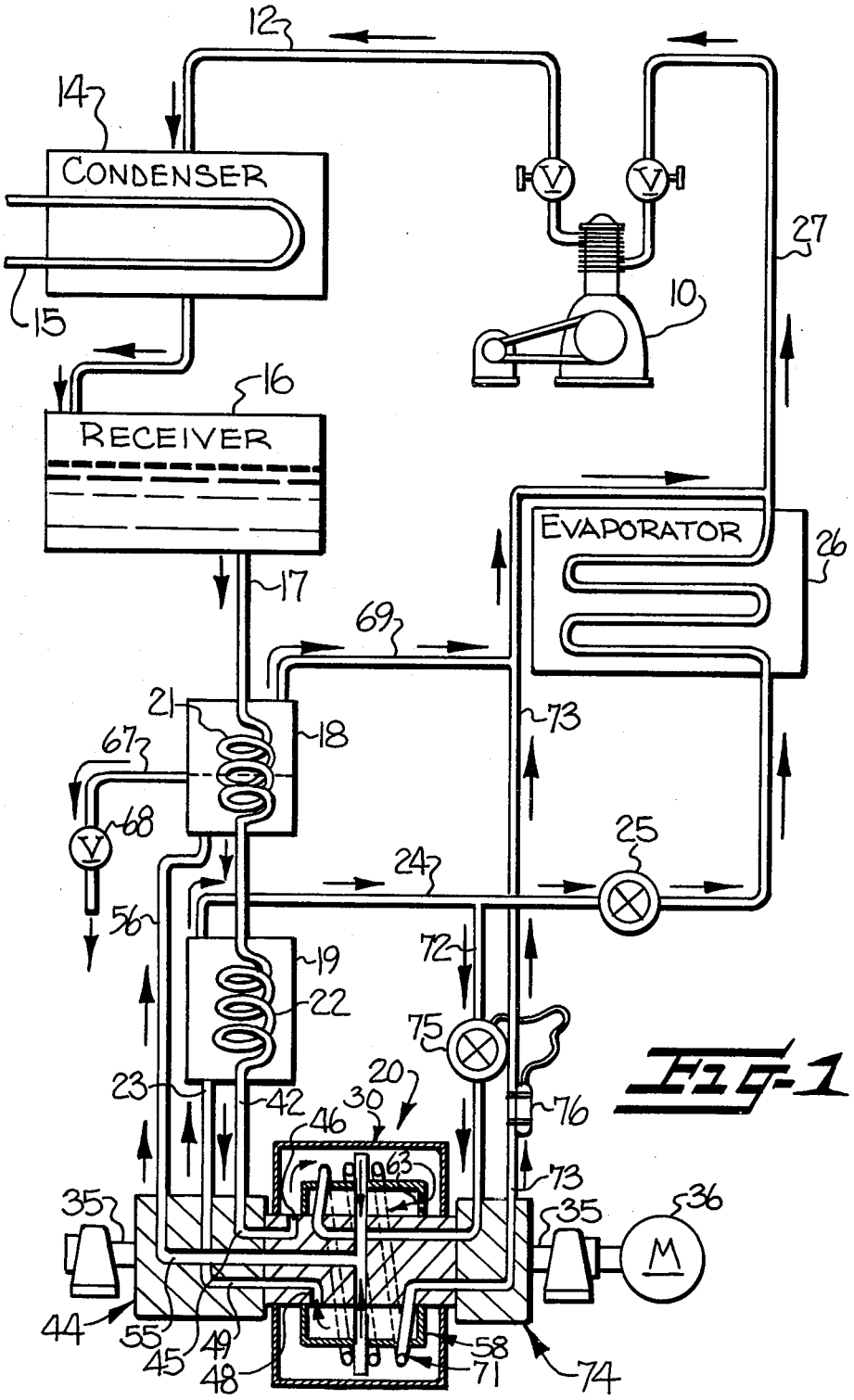

The present invention relates to a method and apparatus for providing refrigeration, and specifically, to a method and apparatus for effectively separating oil from the refrigerant in a vapor compression refrigeration apparatus to improve the heat transfer efficiency.

It has long been recognized that at least some oil escapes from the compressor utilized in a vapor compression refrigeration system, and that the oil is absorbed in the refrigerant. The absorbed oil passes through the condenser, and condenses and collects as a film in the evaporator, where it acts to reduce heat transfer and thus the cooling efficiency of the system.

To remove the oil from the refrigerant, it is common to mount an oil separator in the refrigerant line between the compressor and condenser. Such prior separators typically utilize a sharply turning flow path to cause separation, and they are able to achieve a maximum oil removal efficiency of about 90 to 95%. Thus a relatively substantial amount of oil remains in the refrigerant, which in time can seriously interfere with the heat transfer efficiency of the evaporator.

It is accordingly an object of the present invention to provide a method and apparatus adapted for continously and efficiently separating oil from the liquid refrigerant in a refrigeration system.

It is a more specific object of the present invention to provide a method and apparatus for supplying refrigeration, and which is characterized by the ability to remove substantially all of any oil in the refrigerant to thereby improve the heat transfer efficiency.

These and other objects and advantages of the present invention are achieved in the embodiment illustrated herein by the provision of a vapor compression refrigeration apparatus which comprises a compressor, a condenser, an evaporator, and an oil separator for removing oil from the liquid refrigerant and which comprises means for continuously centrifuging the liquid refrigerant passing therethrough, to separate the oil from the refrigerant. Further, the apparatus preferably includes means for cooling the liquid refrigerant while passing through the separator to facilitate the separation of the oil from the refrigerant.

In the preferred and illustrated embodiment, the oil separator includes a closed cylindrical container, a shaft fixed to the container and extending at least partially therethrough, means for rotating the shaft and thus the container, a liquid entry channel extending axially through the shaft for delivering the refrigerant into the interior of the container during rotation thereof, a first liquid exit channel extending axially through the shaft and having an exit opening within the container closely adjacent the axis of the shaft for conveying a lighter liquid component from the container during rotation thereof, and a second liquid exit channel extending axially through the shaft and having an exit opening within the container adjacent the radially outer periphery thereof for conveying the heavier liquid component from the container during rotation thereof. To cool the interior of the container during rotation thereof, there is further provided a coil mounted within the container, and conduit means extending axially through the shaft for circulating a cooling fluid through the coil during rotation of the container.

Figures 2, 3:
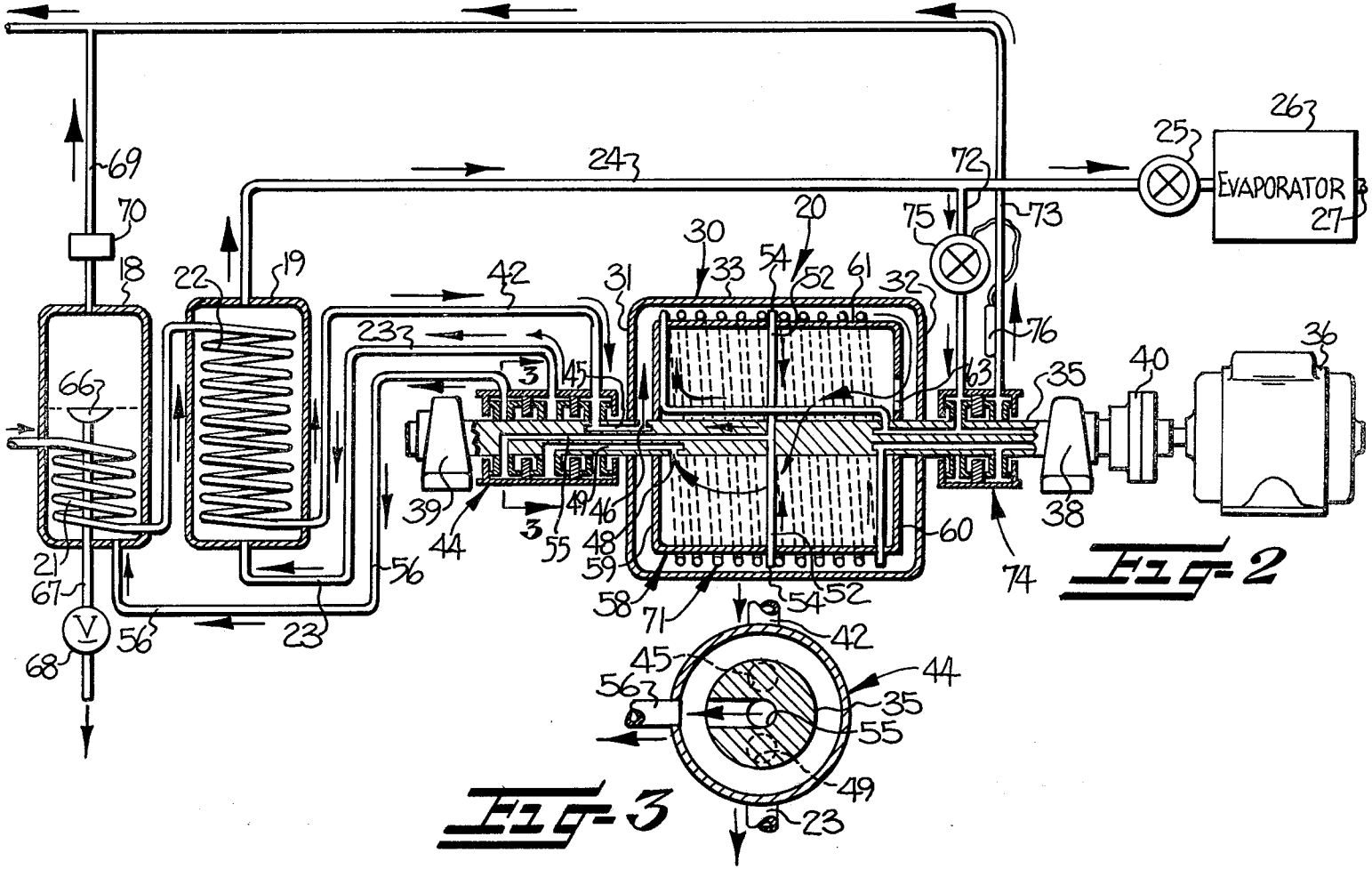

Some of the objects having been stated, other objects will appear as the description proceeds, when taken in connection with the accompanying drawings in which FIG. 1 is a schematic representation of a refrigeration apparatus embodying the features of the present invention;

FIG. 2 is a more detailed schematic representation of the oil separator of the refrigeration apparatus illustrated in FIG. 1; and FIG. 3 is a transverse sectional view taken substantially along the line 3—3 of FIG. 2.

Referring more specifically to the drawings, FIG. 1 schematically illustrates a vapor compression refrigeration apparatus which embodies the features of the present invention, and which comprises a compressor 10 for raising the pressure and temperature of a gaseous refrigerant, such an ammonia or Freon. The relatively hot gaseous refrigerant is transferred through the refrigerant line 12 to a condenser 14, which includes a cold water line 15 for cooling and liquifying the refrigerant. A refrigerant receiver 16 is positioned downstream of the condenser 14 for storing a portion of the liquid refrigerant.

The liquid refrigerant passes from the receiver 16 through the line 17 to the oil separating means, which comprises the serially arranged oil receiving chamber or still 18, heat exchanger 19, and oil separator 20. The refrigerant line includes a coil 21 in the oil still 18, and a second coil 22 in the heat exchanger 19. From the separator 20, the refrigerant passes through the line 23 back to the heat exchanger 19 and then through the line 24 to an expansion valve 25 which acts to regulate the flow and reduce the pressure of the liquid refrigerant passing therethrough. Next, the refrigerant enters an evaporator 26 wherein heat is absorbed from the external cooling load, causing the low pressure refrigerant to boil and vaporize, and from the evaporator 26, the vaporized refrigerant is returned via the line 27 to the suction side of the compressor 10.

To more specifically describe the oil separator 20, there is provided a closed cylindrical container 30 which is composed of two end walls 31, 32, and a cylindrical outer wall 33. A shaft 35 is fixed to and extends axially through the container 30, and a motor 36 is provided for rotating the shaft and thus the container about the axis of the shaft. As best seen in FIG. 2, the shaft is rotatably mounted between the bearings 38, 39, and the motor 36 acts through the flexible coupling 40 to rotate the shaft 35.

The refrigerant enters the container 30 through liquid entry channel means, which comprises the entry line 42, the associated portion of the mechanical seal assembly 44, and a channel 45 which extends axially through the shaft to a delivery opening 46 which is located within the container and on the periphery of the shaft.

First liquid exit channel means is provided for conveying the separated refrigerant (i.e. the lighter liquid component) from the container during rotation thereof. This exit channel means comprises an exit opening 48 on the periphery of the shaft 35, a channel 49 extending axially through the shaft, the associated portion of the mechanical seal assembly 44, and the refrigerant line 23. There is also provided second liquid exit channel means for conveying the separated oil (i.e. the heavier liquid component) from the container during rotation thereof. The second exit channel means comprises a number of radially directed siphon lines 52 disposed within the container 30, with each siphon line 52 defining an exit opening 54 which is immediately adjacent the inner side of the cylindrical wall 33 of the container. The siphon lines communicate with a channel 55 which extends axially through the shaft, which in turn communicates with an external oil line 56 via the associated portion of the mechanical seal assembly 44.

The oil separator 20 further includes a hollow drum 58 mounted within the container 30 and fixed for rotation with both the container and the shaft 35. The drum 58 has opposite end walls 59, 60 which are axially spaced from respective end walls 31, 32 of the container, and an outer cylindrical wall 61 which is inwardly spaced from the outer wall 33 of the container. The walls of the drum are closed, with the exception of a passageway 63 through the end wall 60 thereof. Also, it will be understood from FIG. 2 that the siphon lines 52 extend radially through the cylindrical wall 61 of the drum in a sealed manner.

From the above, it will be seen that the refrigerant initially enters the container 30 adjacent the axis of the shaft and within the space between the end wall 31 of the container and the end wall 59 of the drum. The refrigerant is thus initially directed radially outwardly between these two end walls by centrifugal force, and it then moves axially along the space between the outer wall 33 of the container and the outer wall 61 of the drum. At this point, the heavier oil is separated from the refrigerant and is thus positioned on the inner side of the wall 33 of the container. The refrigerant continues to move axially between the two outer walls, then between the opposite pair of end walls 32 and 60, and into the interior of the drum through the passageway 63. Finally, the refrigerant enters the exit opening 48 of the first liquid exit channel means, and passes outwardly to the line 23. The oil on the other hand, enters the exit opening 54 of the second liquid exit channel means, and exits via the siphon line 52 and channel 55 to the oil line 56.

The refrigerant line 23 which leaves the oil separator communicated with the interior of the heat exchanger 19. The line 56 which conveys the oil from the separator extends into the interior of the oil still 18, and the oil still 18 includes a drain 66 for maintaining a predetermined oil level therein, and which in turn communicates with the drain line 67 which has a valve 68 to permit periodic removal of the collected oil. Further, a line 69 communicates with the interior of the oil still for conveying the recovered refrigerant to the suction line 27 of the compressor. The line 69 preferably includes a conventional pressure regulator 70.

The oil separator 20 also preferably includes means for cooling the interior of the container during rotation thereof, to thereby lower the temperature of the refrigerant passing therethrough and thereby facilitate the separation of the oil from the refrigerant. In the illustrated embodiment, the cooling means comprises a coil 71 helically disposed about the outer surface of the drum 58, and an entering line 72 and an exiting line 73, each of which includes portions which extend axially through the shaft, and through the mechanical seal assembly 74, for circulating a cooling fluid through the coil 71 during rotation of the container. The entering line 72 communicates with the refrigerant line 24 at a point upstream of the expansion valve 25, and further includes a second expansion valve 75. The exiting line 73 leads to the suction line 27 of the compressor, and mounts a sensor 76 for controlling the second expansion valve 75. Thus the cooling means for the oil separator takes the form of a second evaporator coil which is disposed in parallel with the evaporator 26 of the main refrigeration system.

In operation, the relatively hot liquid refrigerant from the receiver 16 passes through the coil 21 in the oil still 18, to heat the oil therein and vaporize any refrigerant which may be dissolved in the oil. The vaporized refrigerant then returns to the suction line 27 of the compressor via the line 69, and the oil is periodically removed through the drain line 67.

The refrigerant continues to the coil 22 of the heat exchanger 19, where it is cooled by contact with the liquid refrigerant which has been cooled in the oil separator 20. Next, the refrigerant passes through the liquid entry line 42 into the container 30 where any oil therein is separated in the manner described above. The separated refrigerant leaves the separator through the line 23, and again passes through the heat exchanger 19 where it absorbs heat from the relatively hot refrigerant in the coil 22. The refrigerant then continues through the line 24 to the expansion valve 25 and evaporator 26.

In the drawings and specification, there has been set forth a preferred embodiment of the invention, and although specific terms are employed, they are used in a generic and descriptive sense only and not for purposes of limitation.

That which is claimed is:

1. A vapor compression refrigeration apparatus comprising a compressor for raising the pressure of a gaseous refrigerant, a condenser for cooling and liquifying the refrigerant, oil separating means for removing oil from the liquid refrigerant, an expansion valve for regulating the flow and reducing the pressure of the liquid refrigerant, an evaporator for transferring heat from the substance being cooled to boil the low pressure liquid refrigerant, and conduit means for serially directing the refrigerant through said components, the improvement wherein said oil separating means comprises driven rotatable means for continuously centrifuging the liquid refrigerant passing therethrough to separate the oil from the refrigerant.

2. The apparatus as defined in claim 1 wherein said centrifuging means comprises a rotatable container, drive means for rotating said container while the liquid refrigerant passes therethrough, and means for continuously removing the separated oil from said container.

3. A vapor compression refrigeration apparatus comprising a compressor for raising the pressure of a gaseous refrigerant, a condenser for cooling and liquifying the refrigerant, oil separating means for removing oil from the liquid refrigerant, an expansion valve for regulating the flow and reducing the pressure of the liquid refrigerant, an evaporator for transferring heat from the substance being cooled to boil the low pressure liquid refrigerant, and conduit means for serially directing the refrigerant through said components, the improvement wherein said oil separating means comprises a rotatable container, means for rotating said container while the liquid refrigerant passes therethrough for continuously centrifuging the liquid refrigerant passing therethrough to separate the oil from the refrigerant, means for continuously removing the separated oil from said container, and means for cooling the liquid refrigerant while passing through said container to facilitate the separation of the oil.

4. The apparatus as defined in claim 3 wherein said cooling means comprises a heat exchange coil operatively disposed with respect to said container, and means for conveying a portion of the liquid refrigerant through said heat exchange coil.

5. The apparatus as defined in claim 4 wherein said means for conveying a portion of the refrigerant through said heat exchange coil comprises a first refrigerant line having one end connected to said conduit means at a point immediately upstream of said expansion valve and an opposite end connected to one end of said heat exchange coil, a second expansion valve operatively disposed in said first refrigerant line, and a second refrigerant line having one end connected to the opposite end of said heat exchange coil and an opposite end connected to said conduit means at a point immediately upstream of said compressor.

6. The apparatus as defined in any one of claims 1 through 5 wherein said oil separating means further comprises means for recovering refrigerant from the separated oil, said recovering means comprising an oil receiving chamber, means for conveying the separated oil from said centrifuging means to said chamber, and heat exchange means operatively disposed between that portion of said conduit means containing relatively hot liquid refrigerant and said chamber for heating the oil in said chamber and vaporizing the refrigerant therein.

7. The apparatus as defined in any one of claims 3, 4, or 5 wherein said oil separating means further comprises heat exchange means disposed between that portion of said conduit means immediately upstream of said rotatable container and that portion of said conduit means immediately downstream of said container, to thereby lower the temperature of the refrigerant prior to entering said container and raise the temperature of the refrigerant leaving said container.

8. A method of providing refrigeration utilizing a refrigerant capable of releasing heat by condensing from a vapor at a relatively high pressure, and absorbing heat by evaporating at a relatively low pressure, and characterized by the ability to remove substantially all of any oil in the refrigerant to thereby improve the heat transfer efficiency, and comprising the continuous steps of compressing and heating a gaseous refrigerant, removing heat from the compressed refrigerant to cool and condense the same, passing the condensed liquid refrigerant into a driven rotatable container and centrifuging the condensed liquid refrigerant to separate the oil therefrom, removing the separated oil from the liquid refrigerant, reducing the pressure of the liquid refrigerant subsequent to the centrifuging and removing steps, evaporating the liquid refrigerant at the reduced pressure to absorb heat and thereby provide cooling for an external load, and recycling the evaporated refrigerant to become the source of the gaseous refrigerant in the above recited compressing and heating step.

9. The method as defined in claim 8 wherein the centrifuging step includes cooling the liquid refrigerant to facilitate the separation of the oil.

10. A method of providing refrigeration utilizing a refrigerant capable of releasing heat by condensing from a vapor at a relatively high pressure, and absorbing heat by evaporating at a relatively low pressure, and characterized by the ability to remove substantially all of any oil in the refrigerant to thereby improve the heat transfer efficiency, and comprising the continuous steps of compressing and heating a gaseous refrigerant, removing heat from the compressed refrigerant to cool and condense the same, centrifuging the condensed liquid refrigerant to separate the oil therefrom while cooling the liquid refrigerant to facilitate the separation of the oil, removing the separated oil from the liquid refrigerant, reducing the pressure of the liquid refrigerant subsequent to the centrifuging and removing steps, evaporating the liquid refrigerant at the reduced pressure to absorb heat and thereby provide cooling for an external load, recycling the evaporated refrigerant to become the source of the gaseous refrigerant in the above recited compressing and heating step, heating the separated and removed oil to vaporize any refrigerant therein, and utilizing the thus recovered refrigerant as a further source of the gaseous refrigerant in the compressing and heating step.

11. The method as defined in claim 10 wherein the heating step comprises bringing the oil into heat exchange relation with the condensed liquid refrigerant prior to the centrifuging step.

12. The method as defined in any one of claims 10 or 11 comprising the further step of cooling the liquid refrigerant prior to the centrifuging step by bringing the liquid refrigerant into heat exchange relation with liquid refrigerant which has been centrifuged and cooled.

* * * * *